US005377658A

United States Patent [19]

Shepley, Jr.

[11] Patent Number: 5,377,658

[45] Date of Patent: Jan. 3, 1995

[54] REINFORCEMENT FOR BOW LIMB

[75] Inventor: Paul E. Shepley, Jr., Tucson, Ariz.

[73] Assignee: Precision Shooting Equipment, Inc., Tucson, Ariz.

[21] Appl. No.: 43,472

[22] Filed: Mar. 29, 1993

[51] Int. Cl.[6] ..... F41B 5/00

[52] U.S. Cl. ..... 124/88; 124/25.6; 124/23.1

[58] Field of Search ..... 124/23.1, 25.6, 1, 88; 156/265, 293, 245; 264/275, 279

[56] References Cited

U.S. PATENT DOCUMENTS

| | | | |
|---|---|---|---|
| 3,806,398 | 4/1974 | Lasser | 264/275 |
| 4,093,491 | 6/1978 | Whelpton | 156/293 |
| 4,333,443 | 6/1982 | Roelle | 124/25.6 |
| 4,405,398 | 9/1983 | Rother | 264/275 |
| 4,561,413 | 12/1985 | Jennings | 124/25.6 |
| 4,649,889 | 3/1987 | Johnston | 124/25.6 |
| 4,671,249 | 6/1987 | Troncoso | 124/25.6 |
| 4,865,792 | 9/1989 | Moyer | 156/293 |
| 4,970,103 | 11/1990 | Wolf | 264/275 |
| 5,141,689 | 8/1992 | Simonds | 124/23.1 |
| 5,174,268 | 12/1992 | Martin | 124/25.6 |

*Primary Examiner*—Randolph A. Reese
*Assistant Examiner*—Anthony Knight
*Attorney, Agent, or Firm*—Cahill, Sutton & Thomas

[57] ABSTRACT

The fork in the limb of a compound archery bow is reinforced with a collar having a flange for stiffening the collar and fitting within the fork. The flange is glued to the inside of the fork to strengthen the joint between the rest of the collar and the fork. A hole in a limb is reinforced with a cylindrical flange having an annular disk extending over a major surface of the limb. Both the cylindrical flange and the disk are glued to the limb.

9 Claims, 2 Drawing Sheets

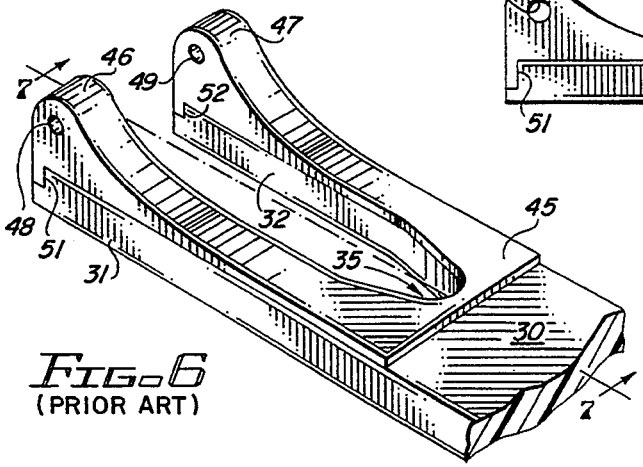
FIG. 6
(PRIOR ART)
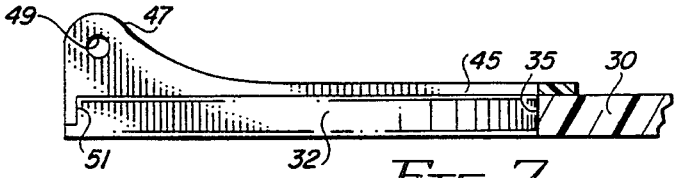
FIG. 7
(PRIOR ART)
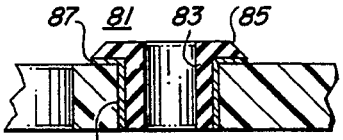
FIG. 13
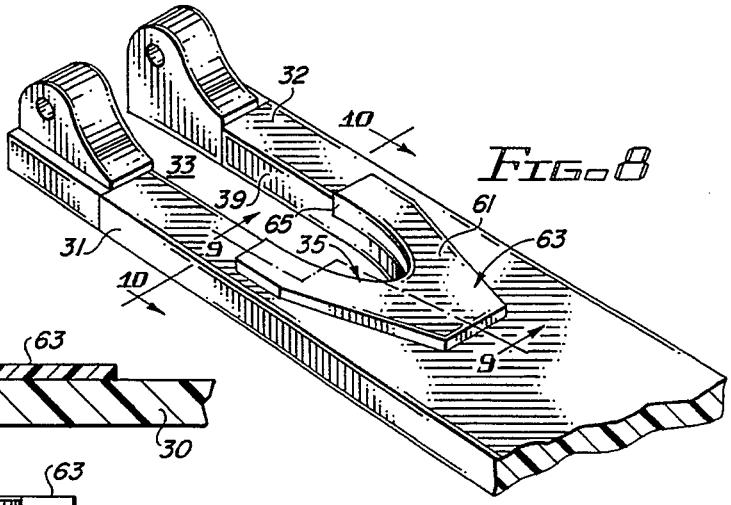
FIG. 8
FIG. 9
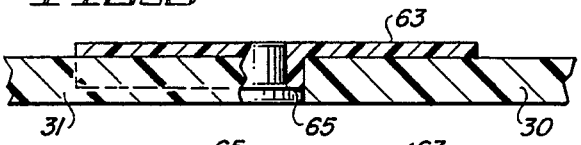
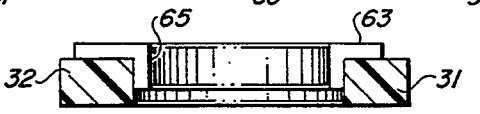
FIG. 10
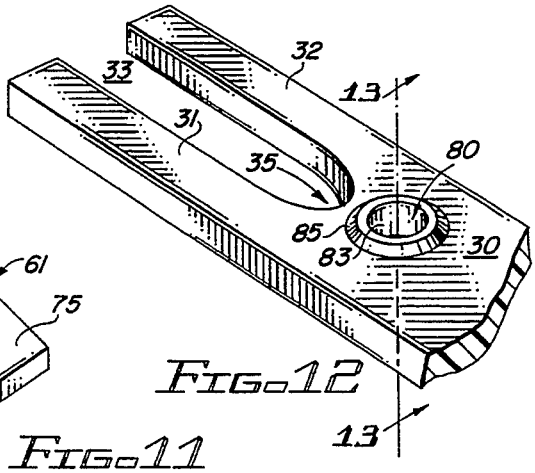
FIG. 12
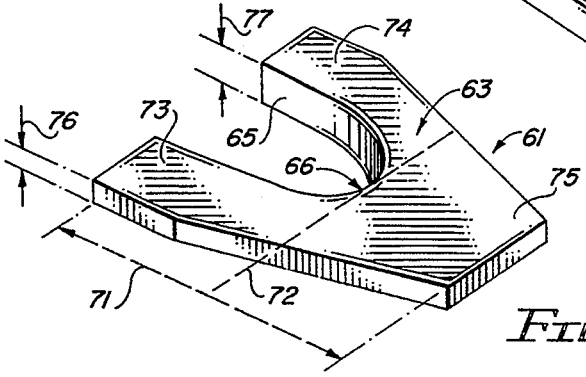
FIG. 11

REINFORCEMENT FOR BOW LIMB

BACKGROUND OF THE INVENTION

This invention relates to archery bows and, in particular, to a limb reinforcement for compound archery bows.

A compound bow differs from a long bow in that a block and tackle mechanism is used to bend the bow: pulleys or wheels are attached at the free ends of the limbs to obtain a mechanical advantage in bending the bow. The free end of each limb is forked and a wheel turns within the fork on an axle attached to the ends of the fork. The wheels are eccentrically mounted, enabling one to use a much higher draw weight because the wheels provide a substantial "let off" or reduction in holding force of a drawn bow.

A compound bow is typically made in three pieces: an elongated, rigid handle and a pair of limbs. One end of each limb is attached to respective ends of the handle. A limb is an elongated member having a width greater than its thickness and is typically thinner and wider at the middle than at the ends. Holding a limb in ones hand, it seems unlikely that the limb can flex at the middle as the bow is drawn and even less likely that the ends could be twisted. However, because of the large forces in a compound bow, a limb not only flexes at the middle but bends and twists at the ends as well. The twisting is caused by the torques from the lacing connecting the wheels and limbs.

Compound bows typically have lacing wound from an anchor at one end of a first limb to the wheel at the end of the other limb, to the wheel at the end of the first limb, then back to an anchor at the end of the other limb. The middle span between the wheels is the bowstring for receiving the nock of the arrow. The wheel at the end of each limb has two grooves in its perimeter for receiving the lacing. The grooves in the wheel are spaced along the axle, to which the anchor for the end of the lacing is also attached. Thus, these components are spaced along the axle across the width of the limb.

The substantial forces from the lacing combined with the spacing cause torques on the free ends of the limbs which twist the limbs. Moreover, the torques vary as the bowstring is drawn and released. In general, the tension on the bowstring is greatest when the bow is at rest and least when the bow is fully drawn. The situation is reversed in the rest of the lacing: the tension is least when the bow is at rest and greatest when the bow is drawn. As a result of these changing forces, the ends of the limbs twist one way and then the other each time that the bow is drawn.

The fork at the end of the limb is the weakest part of the limb because material is removed from the central portion of the end to provide clearance for the wheel. Any twist at the end of the limb tends to split the limb at the inner end of the fork. The problem has been recognized in the past and a variety of solutions, described in more detail below in conjunction with the drawings, have been used to reinforce the limb. In general, the proposed solutions reinforced the limb by gluing a plate to the limb at the inner end of the fork. A solution of a different kind was to drill a hole in the limb adjacent the inner end of the fork and to attach a bolt through the hole as a rip stop. While originally thought to be effective, these solutions have proven inadequate as draw weights increase and as archers tighten limb bolts past the maximum draw weight of a bow.

As used herein, "plate" refers to a planar member glued to the outer surface of the fork as a reinforcement and "collar" refers to a reinforcement constructed in accordance with the invention. A plate differs from a collar in that, ignoring thickness, a plate is a two dimensional object while a collar is a three dimensional object. The distinction will be more apparent after considering the detailed description of the invention.

A plate is effective until the twisting of the fork exceeds the peel strength of the adhesive fastening the plate to the limb. Then, although the plate itself did not fail, it is no longer effective since it is not fully attached to the limb. The separation may not be visible until the limb itself cracks.

In view of the foregoing, it is therefore an object of the invention to provide an improved limb reinforcement for compound bows.

Another object of the invention is to provide a limb reinforcement attached to the limb in three dimensions.

A further object of the invention is to provide a three dimensional reinforcement which itself resists twisting.

SUMMARY OF THE INVENTION

The invention achieves the foregoing objects with a limb collar having a flat or planar portion and a flange perpendicular to the planar portion. The planar portion and flange reinforce each other to resist flexing and twisting. The flange curves to conform to the shape of the inner end of the fork. The planar portion is glued to a major surface of the limb and the flange is glued to the inside of the fork. In accordance with another aspect the invention, a hole in a limb is reinforced with a cylindrical flange having an annular disk attached to one end. The disk extends over a major surface of the limb and the cylindrical flange is located in the hole. Both the disk and the cylindrical flange are glued to the limb. In either aspect of the invention, the attachment in three dimensions increases the resistance of the reinforcement to peeling.

BRIEF DESCRIPTION OF THE DRAWINGS

A more complete understanding of the invention can be obtained by considering the following detailed description in conjunction with the accompanying drawings, in which:

FIG. 6 illustrates another plate of the prior art;

FIG. 7 is a cross-section of the plate through line 7—7 in FIG. 6;

FIG. 8 illustrates a limb constructed in accordance with the invention;

FIG. 9 is a cross-section of the limb through line 9—9 in FIG. 8;

FIG. 10 is a cross-section of the limb through line 10—10 in FIG. 8;

FIG. 11 is a perspective view of a collar constructed in accordance with a preferred embodiment of the invention, FIG. 12 illustrates a reinforcement constructed accordance with another aspect of the invention.

FIG. 13 is a cross-section of the reinforcement of FIG. 12 along line 13—13.

DETAILED DESCRIPTION OF THE INVENTION

Figure 1:
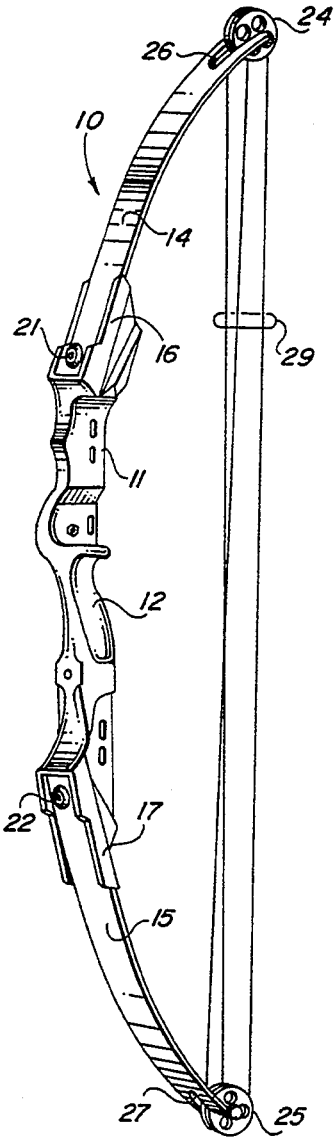
FIG. 1 illustrates the major components of a compound archery bow.

In FIG. 1, compound bow 10 includes handle 11 having grip 12, by which the archer holds the bow. Limbs 14 and overlap the ends of handle 11, resting in pockets 16 and 17. Limb bolt 21 secures one end of limb 14 to handle 11 and limb bolt 22 secures one end of limb 15 to handle 11. The free ends of limbs 14 and 15 are forked and an axle is attached to the ends of each fork across the width of the limb. Wheels 24 and 25 turn on respective axles within the clefts of forks 26 and 27. Lacing 29 interconnects the limbs and wheels and holds these pieces in place on handle 11. The limbs pivot around the ends of handle 11 as limb bolts 21 and 22 are adjusted.

Figure 2:
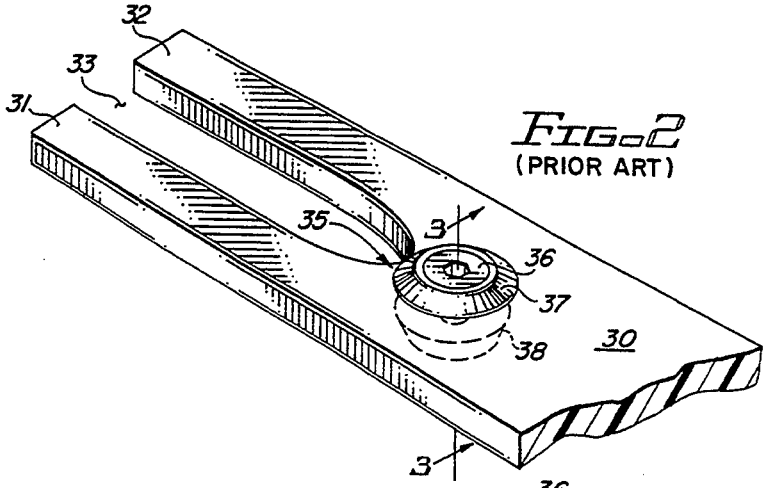
FIG. 2 (PRIOR ART)
FIG. 2 illustrates the end of a limb with a button reinforcement of the prior art.
Figure 3:
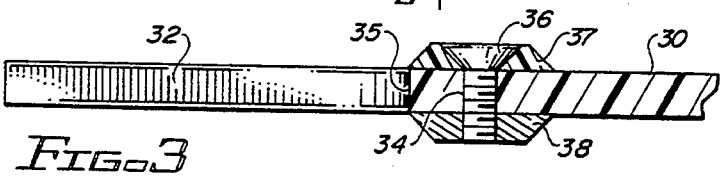
FIG. 3 (PRIOR ART)
FIG. 3 is a cross-section of a limb fork along line 3—3 in FIG. 2.

FIGS. 2 and 3 illustrate what is known as a button reinforcement on the free end of a limb. The free end of limb 30 is forked, forming tines 31 and 32 separated by cleft 33. Inner end 35 of cleft 33 is typically U-shaped. For a button reinforcement, hole 34 is drilled through limb 30 a short distance from inner end 35. Bolt 36 is inserted through washer 37 and through hole 34 in limb 30. Bolt 36 is held in place by nut 38 on the underside of limb 30.

As tines 31 and 32 twist or bend in opposite directions, a great deal of stress is placed upon limb 30 at inner end 35. If a crack should begin to develop, it typically begins at inner end 35 and moves down the length of limb 30 toward the handle. Since hole 34 is adjacent inner end 35, any crack which begins to form terminates in the hole. Washer 37 and nut 38 resist twisting somewhat and help prevent the crack from extending down the length of the limb.

Figure 4:
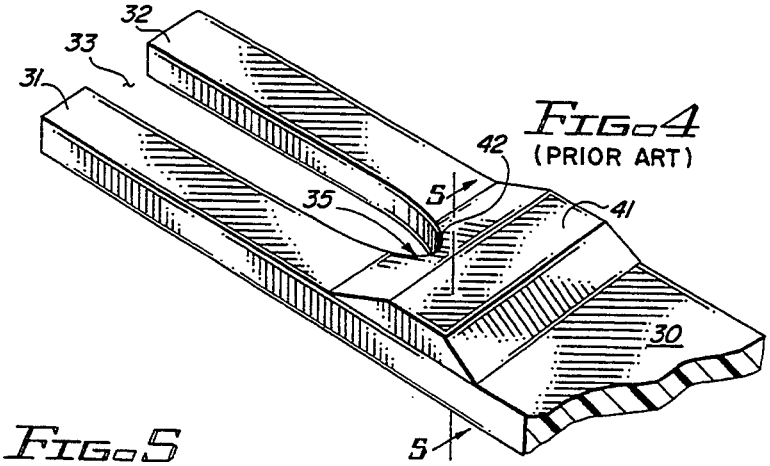
FIG. 4 (PRIOR ART)
FIG. 4 illustrates a limb with a plate attached to the outer surface of a limb.
Figure 5:
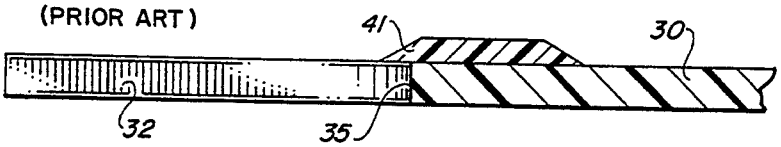
FIG. 5 (PRIOR ART)
FIG. 5 is a cross-section of the plate through line 5—5 in FIG. 4.

FIGS. 4 and 5 illustrate a plate reinforcement extending across the width of a limb. The length and width of limb 30 define two major surfaces separated by the thickness of the limb. The outer surface is the generally convex surface of the limb when the limb is part of a strung bow, i.e. the surface seen by an observer facing an archer. A plate is typically attached to the outer surface of the limb, as shown in FIGS. 4 and 5, with a suitable adhesive, such as epoxy. Plate 41 has a trapezoidal cross-section, partially for aesthetic reasons and partially to reduce peeling by providing a less rigid edge. Notch 42 conforms plate 41 to the shape of inner end 35.

The forces on a compound bow are very large and change abruptly as the bow is fired. Plate 41 resists tines 31 and 32 moving in opposite directions. This resistance depends upon the stiffness of plate 41 and causes stress the adhesive between plate 41 and limb 30. For example, as tine 31 moves downward (oriented as shown in FIG. 4) and tine 32 moves upward, plate 41 resists twisting and pulls up on tine 31. The effect is to peel plate 41 away from tine 31. When the torques change, as described above, and the twist reverses, then the effect is to peel plate 41 away from tine 32. Limb failure is usually in the adhesive rather than in the plate.

FIGS. 6 and 7 illustrate another plate known in the art. Plate 45 actually combines a plate and wheel anchors in a single piece. Ignoring wheel anchors 46 and 47, plate 45 differs from plate 41 in that plate 41 is almost entirely below inner end 35 while plate 45 is almost entirely above inner end 35. As used herein, "below" and "above" indicate proximity to grip 12. For example, in FIG. 1, limb bolt 21 is below wheel 24 because it is closer to grip 12. Similarly, limb bolt 22 is below wheel 25 because it is closer to grip 12.

Plate 45 surrounds inner end 35 and extends toward the free ends of tines 31 and 32. Wheel anchors 46 and 47 overlie the ends of tines 31 and 32 and include holes 48 and 49 for the axle upon which the wheel rotates. The tips of tines 31 and 32 include notches 51 and 52 for providing a large gluing surface for wheel anchors 46 and 47. Except for the wheel anchors, plate 45 has a substantially constant thickness. Plate 45 and plate 41 are planar, overlie the outer surface of limb 30, and do not extend along the outside edges of limb 30 nor into cleft 33.

As tines 31 and 32 move in opposite directions, the twisting action stresses the adhesive as plate 45 attempts to peel away from tines 31 and 32. If the connection between plate 45 and the limb is broken, plate 45 no longer reinforces the fork of limb 30 even if the plate itself is intact.

The problems described above with reinforcements of the prior art are overcome with the collar of the invention. In FIG. 8, collar 61 extends from inner end 35 approximately the same distance in opposite directions along the length of limb 30. Collar 61 includes planar portion 63 and flange 65. Flange 65 is a curved surface perpendicular to planar portion 63 and conforms to the shape of cleft 33, as shown in FIG. 9. Collar 61 is a single piece of material, preferably a molded, semi-rigid plastic. Flange 65 stiffens collar 61 to resist flexing or twisting even when the collar is separate from the limb.

As shown in PIG. 10, planar portion 63 and the perpendicular, curved surface of flange 65 intersect to form an L-shaped cross-section, which provides some of the stiffness of collar 61. This is unlike plates of the prior art, which are essentially planar. For example, ignoring thickness, i.e. making planar portion 63 and flange 65 arbitrarily thin, one would still have a three dimensional object. Ignoring the thickness of the plates of FIGS. 4–7, one would have two dimensional objects.

Additional stiffness comes from the curve of flange 65, conforming to the shape of cleft 33. Cleft 33 has a U-shape rather than a V-shape because twisting stress will spread out over a radius but concentrate at a corner. Spreading the stress enables the limb to withstand the stress. Collar 61 spreads the stress over a wider area still.

Collar 61 is attached to limb 30 by adhesive between planar portion 63 and the limb and between flange 65 and side 39 of limb 30. Any suitable adhesive can be used, such as epoxy or cyanoacrylate. The adhesive is applied to collar 61, the collar is brought into contact with limb 30 at inner end 35, and the adhesive is allowed to dry or cure.

Since collar 61 is glued along flange 65, in a direction perpendicular to planar portion 63, one obtains greatly approved peel strength from the same adhesives as used previously. A collar glued as described above exhibited a lap strength (on the surface of the limb) of 3980 psi (pounds per square inch) and a tensile strength (perpendicular to the surface) of 4880 psi. Thus the flange greatly increases the ability of the collar to resist separation from the limb, In FIG. 11, collar 61 has an overall length 71 extending above and below inner end 66. Line 72 intersects inner end 66, dividing collar 61 into arms 73 and 74 and base 75. Line 72 does not bisect collar 61 lengthwise but is roughly in the middle of the collar. Preferably, the arms are longer than the base, although both contribute to resisting twist. A length ratio of 3:2, arms to base, has been found aesthetically pleasing and mechanically effective. Base 75 also resists cracking or splitting of the limb at the juncture of the tines.

Thickness 76 of collar 61 is a matter of choice but a thickness of approximately one eighth of an inch has been found suitable. An overall length of two to three inches has been found suitable within a broader, useful range. The width of collar 61 depends upon the width of limb 30. The width of arms 73 and 74 is typically one sixth to one third the width of the limb. The arms can completely cover their respective tines or be narrower. Height 77 of flange 65 can be anywhere from fifty to one hundred percent of the thickness of the limb at the point of attachment.

In FIG. 12, hole 80 is located adjacent inner end 35 of cleft 33. Reinforcement 81, resembling a top hat, has cylindrical flange 83 in hole 80 and annular disk 85, attached to one end of the cylindrical flange, extending over a major surface of limb 30. Although described as separate elements, cylindrical flange 83 and member 85 are molded, cast, or machined from a single piece of aluminum or plastic. The outside diameter of cylindrical flange 83 is approximately the same as the inside diameter of hole 80. Adhesive 87 (FIG. 13) is applied around cylindrical flange 83 and underneath annular disk 85 to secure the reinforcement to limb 30. Annular disk 85 on reinforcement 81 helps tines 31 and 32 resist twisting and prevents any tear or shear from propagating down limb 30.

The reinforcements of FIGS. 8 and 12 can be used at either end of a limb. When used at the butt or adjustment end of a limb, a limb bolt can pass through the reinforcement. The cylindrical reinforcement need not be circular; for example, the reinforcement can be elongated along the length of a limb to accommodate the position of a limb bolt at different settings of draw weight.

The invention thus provides an improved limb reinforcement for compound bows in which the reinforcement itself resists twisting and in which the reinforcement is attached to the limb in three dimensions.

Having thus described the invention, it will be apparent to those of skill in the art that various modifications can be made within the scope of the invention. For example, arms 73 and 74 can cover their respective tines and each include a flange extending down the outside edge of limb 30. Alternatively, a pair of planar portions are interconnected by a flange, forming a saddle-like reinforcement in the cleft of the fork. While described as attached to limb 30 by adhesive, collar 61 could be molded into limb 30 at the time limb 30 itself is made. The overall, hexagonal shape of planar portion 63 is determined in part by aesthetics. Other shapes could be used, e.g. a rectangle overlying limb 30 and having flanges on the outsides of limb 30 in addition to flange 65 in the cleft. Although described separately, the collar and top hat reinforcements can be combined into a single reinforcement. Cylindrical flange 83 can be closed or solid instead of hollow and have any desired cross-sectional shape.

I claim:

1. A compound archery bow comprising:

a central handle;

a pair of limbs, each limb having one end attached to said handle and a free end, a cleft in said free end forming a fork; and a pair of limb reinforcements attached to respective limbs at said forks, wherein said reinforcements each include a planar portion and a flange, said flange is perpendicular to said planar portion, extends into said cleft, and conforms to said cleft; and said reinforcements are attached to said limbs by said planar portion and said flange.

2. The compound archery bow as set forth in claim 1 wherein said planar portion extends from said inner end approximately the same distances in opposite directions.

3. A limb for a compound archery bowl said limb comprising an elongated member having a width greater than its thickness and having first and second major surfaces, a cleft through said major surfaces in one end of said member, said cleft having an inner end;

a collar for reinforcing said limb at said cleft, said collar having a planar portion overlying one of said major surfaces and a flange extending into said cleft across said thickness and conforming to the shape of said inner end; and an adhesive bonding said flange and said planar portion to said member.

4. The limb as set forth in claim 3 wherein said planar portion extends from said inner end approximately the same distances in opposite directions along the length of said member.

5. The limb as set forth in claim 3 wherein said second portion extends into said cleft 50–100 percent of said thickness.

6. A compound archery bow comprising:

a central handle;

a first limb and a second limb, each having (i) a first end attached to said handle, said first end having a cleft;

(ii) a second end, and (iii) first and second major surfaces separated by a predetermined distance;

a first reinforcement attached at the cleft of said first limb;

a second reinforcement attached at the cleft of said second limb;

wherein said first reinforcement and said second reinforcement each includes (i) a planar portion attached to one of said major surfaces, and (ii) a flange perpendicular to said planar portion, attached to said limb, and extending across said predetermined distance in the cleft.

7. The compound archery bow as set forth in claim 6 wherein said flange extends 50–100 percent across said predetermined distance,

8. The compound archery bow as set forth in claim 6 wherein said first reinforcement and said second reinforcement are attached to the first ends of said limbs,

9. The compound archery bow as set forth in claim 6 wherein said first reinforcement and said second reinforcement are attached to the second ends of said limbs.

* * * * *